US005131872A

United States Patent [19]

Consoli et al.

[11] Patent Number: 5,131,872

[45] Date of Patent: Jul. 21, 1992

[54] CONTACT SPRING SOCKET

[75] Inventors: John J. Consoli, Harrisburg; Attalee S. Taylor, Palmyra, both of Pa.

[73] Assignee: AMP Incorporated, Harrisburg, Pa.

[21] Appl. No.: 673,861

[22] Filed: Mar. 21, 1991

Related U.S. Application Data

[63] Continuation of Ser. No. 531,181, May 31, 1990, abandoned.

[51] Int. Cl.[5] ..... H01R 13/42

[52] U.S. Cl. ..... 439/751; 439/873; 439/862

[58] Field of Search ..... 439/630-637, 439/78-83, 651, 654, 655, 741, 751, 873, 861, 862

[56] References Cited

U.S. PATENT DOCUMENTS

| | | | |
|---|---|---|---|
| 3,697,926 | 10/1972 | Krafthefer | 439/862 |
| 4,269,468 | 5/1981 | Ammon et al. | 439/637 |
| 4,286,837 | 9/1981 | Yasutake et al. | 439/637 |
| 4,420,215 | 12/1983 | Tengler | 439/862 |
| 4,824,380 | 4/1989 | Mathews | 439/80 |
| 4,828,515 | 5/1989 | Senor et al. | 439/862 |

FOREIGN PATENT DOCUMENTS

| | | | |
|---|---|---|---|
| 2628090 | 1/1977 | Fed. Rep. of Germany | 439/851 |

OTHER PUBLICATIONS

AMP Incorporated Catalog 87-798, pp. 18-21, entitled "IC Sockets" published 1988.

A Portion of a Single Sheet Flyer Regarding AMP Diplomate Sockets.

*Primary Examiner*—David L. Pirlot

[57] ABSTRACT

An electrical socket (10) includes a housing (16) containing spring contacts (32) having a spring geometry to accommodate stub-free insertion and extraction of leads (70) and provide a tolerance accommodating spring action relative to contact post portions (40) inserted into the apertures (14) of a printed circuit board (12) or the like.

3 Claims, 3 Drawing Sheets

CONTACT SPRING SOCKET

This application is a Continuation of application Ser. No. 07/531,181 filed May 31, 1990, now abandoned.

This invention relates to electrical socket housing spring contacts adapted to receive leads plugged therein to connect such to circuit paths on printed circuit boards and the like.

BACKGROUND OF THE INVENTION

Interconnecting the leads of components such as integrated circuits and various discreet devices such as resistors, capacitors, and inductors to the circuit paths of printed circuit boards is accomplished in a variety of ways, soldering such leads being typical for those components which are highly reliable and have long lives. Providing sockets which allow such components to be plugged and unplugged represents an alternative and this may be done by freestanding sockets, sockets loaded into holes in the board and soldered thereto, or through headers which contain rows or arrays of sockets in number and position to receive the plural leads of components. A further alternative is to use the so called compliant pin approach where stamped and formed conductive posts or pins are made to have spring sections which can be compressed by insertion in a board aperture to form a gas tight interconnection. In all the various socket approaches, a common problem has to do with the tolerance of board apertures, not only in diameter, but in true position relative to the arrays of other apertures. This manifests itself in variations from hole to hole and therefore from socket to socket which cause a number of problems, including difficulty of component insertion and extraction, stubbing of lead ends against misaligned sockets, overstressing socket springs, insufficient contact normal forces due to misalignment of sockets and component leads and the like.

Making things perfectly, to tight tolerances is one answer, a very expensive answer. The present invention has as an object the provision of a contact spring socket concept which is inexpensive and yet at the same time, highly adaptable for both board insertion and component lead insertion. The invention has as a further object the provision of a highly compliant socket spring which, because of its geometry, produces board and post stresses to assure consistent insertion and extraction force. The invention socket features anti-overstress and anti-stubbing details and readily facilitates machine assembly of the socket and of sockets into boards.

SUMMARY OF THE INVENTION

The present invention achieves the foregoing objectives through the provision of a housing which slips over an array of contact springs providing an axial cavity for each spring and a beveled aperture for lead insertion. The housing operates to lightly preload each contact spring and the spring includes a geometry which loads the spring in a lateral sense bearing upon the inside wall surfaces of the housing with substantial compliance to preclude sideways forces upon portions of the contact including compliant pin portions inserted into an aperture of a board. The end of the contact spring is bent in a way to present a rounded surface to a lead end and cause the inner portion of the spring to bottom against a further portion of the spring to avoid overstressing the spring bend. Internal housing surfaces bear against surfaces of the contact spring to facilitate mass loading of a multi-spring socket with respect to insertion of the compliant pin portions in multiple apertures.

DETAILED DESCRIPTION OF THE INVENTION

Figure 1:
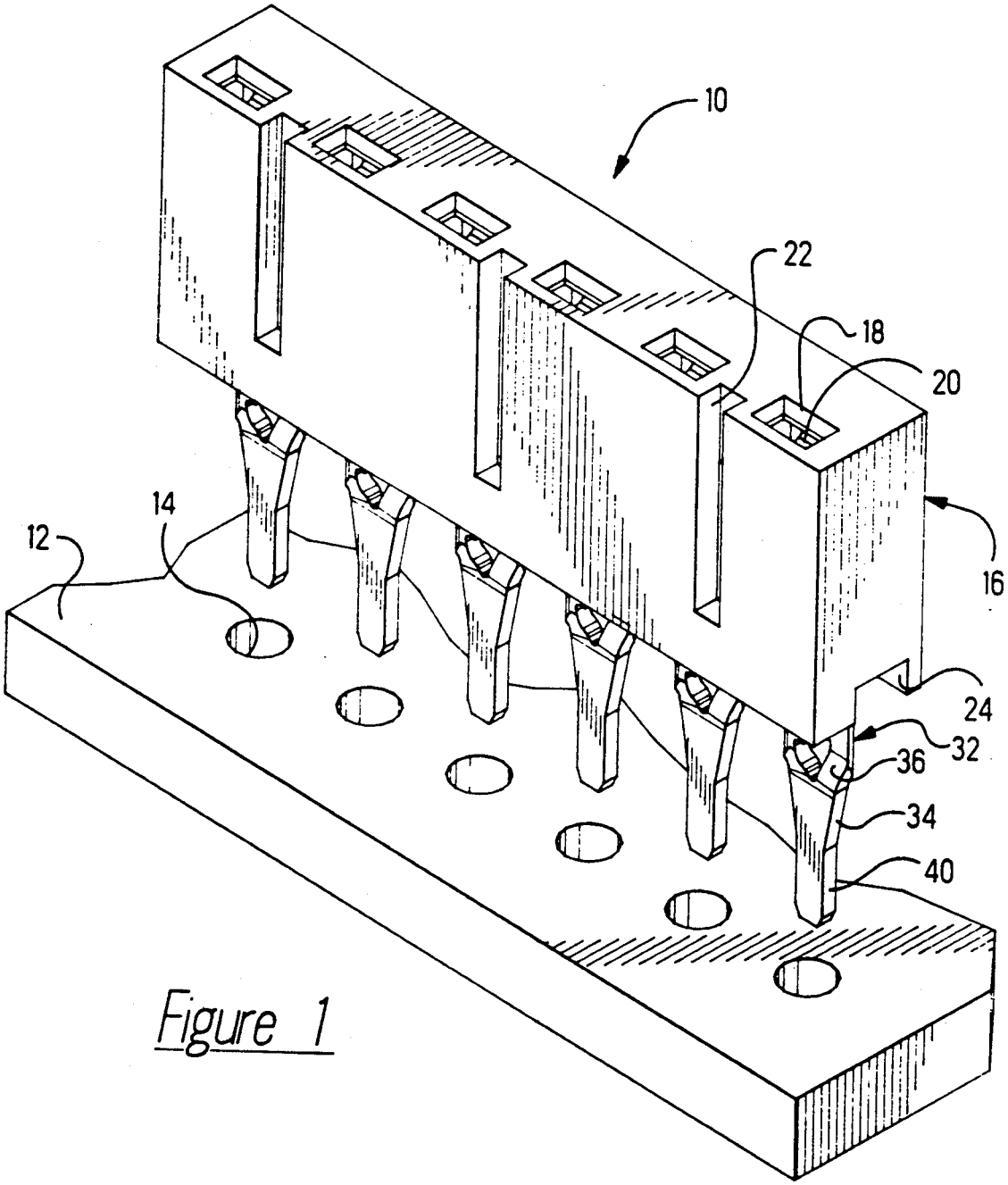
FIG. 1 is a perspective, substantially enlarged from actual size, showing the invention socket positioned above and preparatory to being mounted on a printed circuit board.

In reference to FIG. 1, a socket 10 is shown to include a plastic housing 16 having in the embodiment of FIG. 1 some six apertures 18 in the top surface of the housing. Each of the apertures 18 includes a beveled entry 20 which facilitates lead insertion. A series of reliefs 22 are provided periodically along the length of the housing for visual orientation features. The socket 10 is shown in a single row version, it being understood that multiple sockets can be used to handle dual leaded devices plugged to therein. FIG. 1 further shows the socket 10 containing a series of contacts 32, the ends 40 shown protruding therefrom and aligned for insertion in a printed circuit board 12, the apertures 14 thereof. It is the misalignment of the apertures 14 in either an X or Y sense referencing the top surface of the board which can cause mounting difficulties with respect to the positions of the post portions 40 of the contacts.

Figure 2:
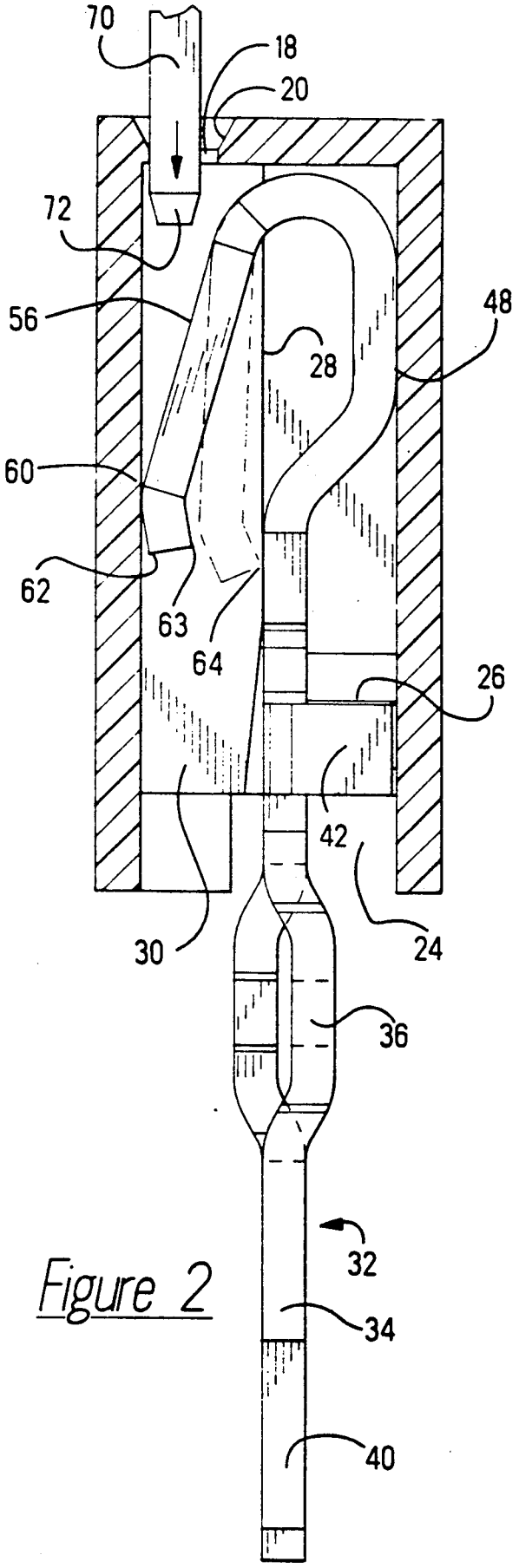
FIG. 2 is a side elevational view in partial section of the socket of FIG. 1, taken through the end of the socket of FIG. 1.

FIG. 2 shows the interior of housing 16 to include a relief 24 at the bottom thereof and with respect to each cavity, a downwardly directed bearing surface 26 and interior walls 28. There are two side walls, one for each side of the cavity 30 defined interiorly of the housing. FIG. 2 also shows the compliant spring portion 36, which can be seen additionally in FIG. 4 to comprise a pair of spring beams offset to allow an interior and elastic deformation as the portion 36 is inserted within a board aperture. FIG. 1 shows a tapering portion 34 which eases entry of the contact into an aperture 14. Above the compliant spring portion 36 is a first U-shaped portion 42 the upper surface of which rests against the bearing surface 26 to allow contact insertion by pushing upon housing 16 with the bearing engagement transmitted through 26 to the portion 42. Viewing FIGS. 2 and 4, there is a further extension portion 46, the outside edges of which bear against the interior walls 28 to stabilize the contact relative to the housing in a sense longitudinal to the length of the housing. Extending above the region including 46 is a U-shaped spring member which includes a flat portion 48, also shown in FIG. 2, to bear against the inside wall on one side of housing 16. The portion 50 of the contact shown in FIG. 3 positions 48 relative to the remainder of the contact. Thereafter and extending from portion 48 is a bend 52 which defines the principal spring of the contact.

Figure 3:
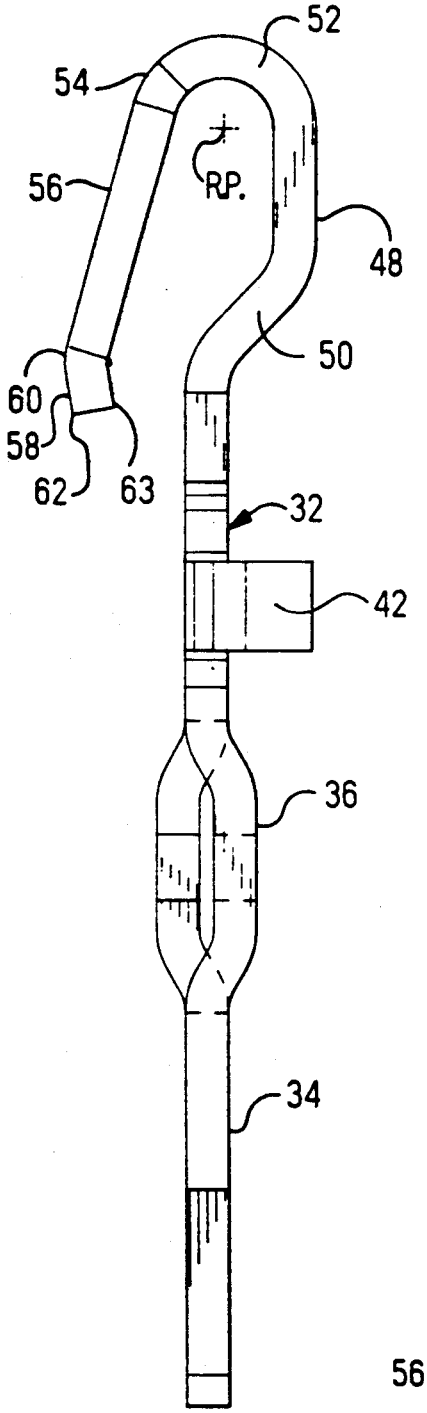
FIG. 3 is a much enlarged elevational side view of the contact of the invention.
Figure 4:
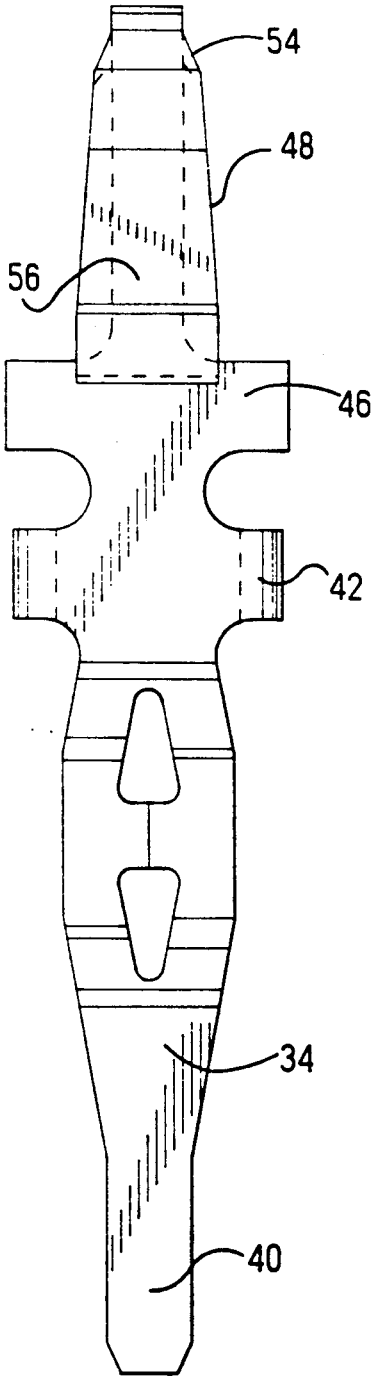
FIG. 4 is a view of the contact of FIG. 3 turned 90 degrees.

Thereafter, the contact material tapers as at 54 to the contact portion 56 which itself tapers as indicated in FIG. 4 and then as indicated in FIG. 3 returns as at 58 towards the center line of the contact. This bend defines an area 60 which is held against the inside wall of housing 16 in the manner shown in FIG. 2 to slightly preload the spring of the contact and additionally position the sharp edge 62 as shown in FIG. 2 inwardly to preclude its contacting a lead inserted within a device. The opposite corner 63 serves to provide an anti-overstress of the spring by virtue of striking the opposing portion of the contact as at 64, shown in phantom in FIG. 2, upon deflection of the spring. As can be appreciated from such view, a lead 70 inserted fully within the housing to a point past the end 62 cannot be caught by such end to thereby trap the lead within the housing and prevent extraction. As lead 70 is inserted within the aperture 18 it will strike the surface 56 deflecting the spring and riding along such surface to be pushed against the interior side wall by area 60 with contact being made between 70 and the contact of the socket through area 60.

Figure 5:
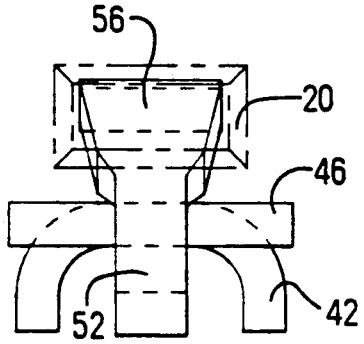
FIG. 5 is a view looking down on the contact of FIGS. 3 and 4 with housing details shown in phantom relative to the position of the contact.

In this condition of loading, the housing and the spring serve to confine the lead and maintain a contact therewith under substantial normal force effecting a stable, low-resistance interface connection between the lead and the contact 32. That interconnection is continued through the compliant spring portion 36 to the board circuits carried in apertures 14. In FIG. 5, the relationship of surface 56 to the aperture and a lead inserted therein can be seen, the width of area surface 56 being such relative to the aperture to preclude a lead from accidentally riding along the side of the contact to become jammed therein or to otherwise damage the contact or the lead.

In an actual embodiment, the contact was formed of a phosphor bronze alloy 5110, temper 6, extra hard, material suitably plated with tin lead. The bend radius of 52 was on the order of 0.014 inches as measured from the radius point R.P. shown in FIG. 3. The housing was molded of glass-filled polyester such as a Vectra A130 suitable for maintaining the spring force by biasing the lead inwardly against the contact.

Having now described the invention intended to enable a preferred practice thereof, claims are set forth which define what is asserted as inventive.

We claim:

1. A contact spring socket for insertion into a cavity of a housing and for engaging a lead of an electrical component, the socket comprising: an elongated spring member having a U-shaped bend between first and second wall engaging portions, the first wall engaging portion of the spring member being adapted to engage a first interior wall of the cavity of the housing, the second wall engaging portion being adapted to engage a second interior wall of the cavity opposing the first interior wall, a contact portion of the spring member between the U-shaped bend and the second wall engaging portion for engaging a lead of an electrical component inserted into an aperture of the housing communicating with a portion of the cavity between the opposed first and second interior walls, an extension portion of the contact adapted to engage against third interior walls of the cavity opposite to the first interior wall, and a second U-shaped portion below the spring member and adapted to engage an inverted wall of the housing facing an open relief at a bottom of the housing.

2. A contact spring socket for receipt in a housing, comprising: an elongated spring member having a Ushaped portion between first and second wall engaging portions, a wall engaging extension portion, and an inverted wall engaging bearing portion, the first wall engaging portion being adapted to engages an interior first wall of the housing, the second wall engaging portion being adapted to engage an interior second wall of the housing, the extension portion being adapted to engage interior third walls of the housing opposite the first wall and adapted to be positioned between the first wall and the second wall, a second U-shaped portion below the spring portion adapted to engage an inverted wall of the housing facing an open relief at a bottom of the housing, and a contact portion between the bend and the second wall engaging portion and adapted to be positioned below an aperture in the housing to receive a lead of an electrical component between the contact portion and the second wall.

3. A contact spring socket for receipt in a housing, comprising: an elongated spring member having a U-shaped portion between first and second wall engaging portions, a wall engaging extension portion, and a second U-shaped bearing portion below the extension portion engaging an inverted wall of the housing, the inverted wall facing an open relief at a bottom of the housing, the first wall engaging portion engaging an interior first wall of the housing, the second wall engaging portion engaging an interior second wall of the housing, the extension portion engaging interior third walls of the housing opposite the first wall and positioned between the first wall and the second wall, a portion of the spring member having a bend to extend from the first wall toward the third walls and toward an end of the spring for antioverstress engagement by the end of the spring member, and a contact portion between the bend and the second wall engaging portion and below an aperture in the housing to receive a lead of an electrical component between the contact portion and the second wall.

* * * * *